US006526723B2

(12) United States Patent
Hovenier

(10) Patent No.: US 6,526,723 B2
(45) Date of Patent: Mar. 4, 2003

(54) DRAFT BLOCK SYSTEM

(75) Inventor: Fred E. Hovenier, Yorba Linda, CA (US)

(73) Assignee: Westbay Holdings, LLC, Corona, CA (US)

( * ) Notice: Subject to any disclaimer, the term of this patent is extended or adjusted under 35 U.S.C. 154(b) by 0 days.

(21) Appl. No.: 09/843,957

(22) Filed: Apr. 27, 2001

(65) Prior Publication Data

US 2002/0157337 A1 Oct. 31, 2002

(51) Int. Cl.[7] ..... E04C 3/30

(52) U.S. Cl. ..... 52/729.1; 52/693; 52/713; 52/236.7; 248/200.1

(58) Field of Search ..... 52/317, 693, 694, 52/695, 696, 690, 729.1, 643, DIG. 6, 657, 638, 713, 236.3, 236.6, 236.7, 407.3; 248/200.1, 57, 70

(56) References Cited

U.S. PATENT DOCUMENTS 4,195,462 A * 4/1980 Keller ..... 52/690
4,715,162 A * 12/1987 Brightwell ..... 52/729
4,947,612 A * 8/1990 Taylor ..... 52/693
5,214,900 A * 6/1993 Folkerts ..... 52/696
5,850,721 A * 12/1998 Martin ..... 52/690
6,170,218 B1 * 1/2001 Shahnazarian ..... 52/713

FOREIGN PATENT DOCUMENTS

GB 2052596 * 4/1980 ..... E04C/3/02
WO PCT/US93/00271 * 6/1992 ..... E04B/1/00

* cited by examiner

*Primary Examiner*—Jose V. Chen
*Assistant Examiner*—Chi Q. Nguyen
(74) *Attorney, Agent, or Firm*—Stetina Brunda Garred & Brucker

(57) ABSTRACT

A draft block joist system for preventing an airflow circulation therethrough. The system comprises a first and second elongated I-beams each having continuous upper and lower flange sections with a panel member disposed therebetween. The upper and lower flange sections of the first elongated I-beam are respectively connected with the upper and lower flange sections of the second elongated I-beam. An air gap is formed between the panel members of the first and second elongated I-beams thereby. By forming the air gap, an insulation member is removably insertable therein for preventing the airflow circulation therethrough.

24 Claims, 2 Drawing Sheets

DRAFT BLOCK SYSTEM

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to a joist system, and more particularly to an improved draft block joist system with a removable insulation member that is specifically sized and configured to prevent an airflow circulation therethrough.

The use of joists to support the weight or loads of structures (e.g., buildings, bridges, residential houses, etc.) is well known. Joists are widely applied in residential and commercial construction industry as well as other industries. More specifically, joists may be defined as any of the lumber or metal beams ranged parallel from wall to wall in a given structure to support a floor or ceiling. For instance, a floor joist generally comprises a piece of lumber used horizontally as support for the floor. Thereafter, a floor sheathing (e.g., plywood) may be nailed on top of the floor joist as a base for the finished floor.

Although joists may be produced from a variety of materials (e.g., steel, concrete, wood, etc.) in order to conform to the structural design, environment, and cost concerns, wooden joists are now primarily used in the residential and commercial construction industry. In addition, increasing costs of lumber have inspired the need for increased efficiency in the design and use of wooden joists. In one response to such problem, wooden joists formed having an "I" shaped configuration ("I-beams") are now being widely utilized. Such I-beam joists are typically manufactured from a pair of parallel wooden flanges that are secured along their lengths by positioning a reinforcement web member therebetween. The flanges and webs are typically manufactured at off site construction facilities and are subsequently transported and installed upon the construction site.

Although such prior art I-beams have proven superior to conventional lumber joists, an air gap, or air gaps, are created when the I-beams are installed together upon the construction site. Such air gaps allow an air draft, or airflow, to circulate through the joist structure, which detrimentally effects heat loss through the floor or ceiling structure of the building. Therefore, the formation of the air gaps poses negative effects upon the effectiveness of the I-beams.

In order to address the problems posed by the air gaps, caulking has typically been utilized by many users in an attempt to fill in such air gaps of the I-beams. Simply put, the air gaps are blocked by caulking the entrance and exit openings thereof in an attempt to prevent the airflow circulation therethrough. However, such caulking methods are inefficient as to the cost and time and are subject to labor skill in properly filling the entire air gap void.

Thus, there exist a need in the residential and commercial construction industry for a draft block joist system for preventing the airflow circulation from flowing through the air gaps formed thereby. In particular, there is a need for a draft block joist system that prevents such airflow circulation in an efficient manner as to the cost and time so as to be user-friendly in its application.

BRIEF SUMMARY OF THE INVENTION

The present invention specifically addresses and alleviates the above referenced deficiencies associated with the use of joist systems of the prior art. In particular, the draft block joist system of the present invention provides differently sized removable pre-formed insulation members that are specifically and correspondingly sized and configured for insertion into such air gaps. More particularly, the insulation members are each preferably fabricated from a fiberglass material to facilitate frictional engagement with the I-beams to immediately and permanently fill the respective air gaps when inserted therein. In this respect, not only does the present invention significantly mitigate the problems posed by the prior art joist systems, but also minimizes labor time and cost in eliminating air gaps, and thus air drafts within the structure.

BRIEF DESCRIPTION OF THE DRAWINGS

These as well as other features of the present invention will become more apparent upon reference to the drawings wherein.

DETAILED DESCRIPTION OF THE INVENTION

Figure 1:
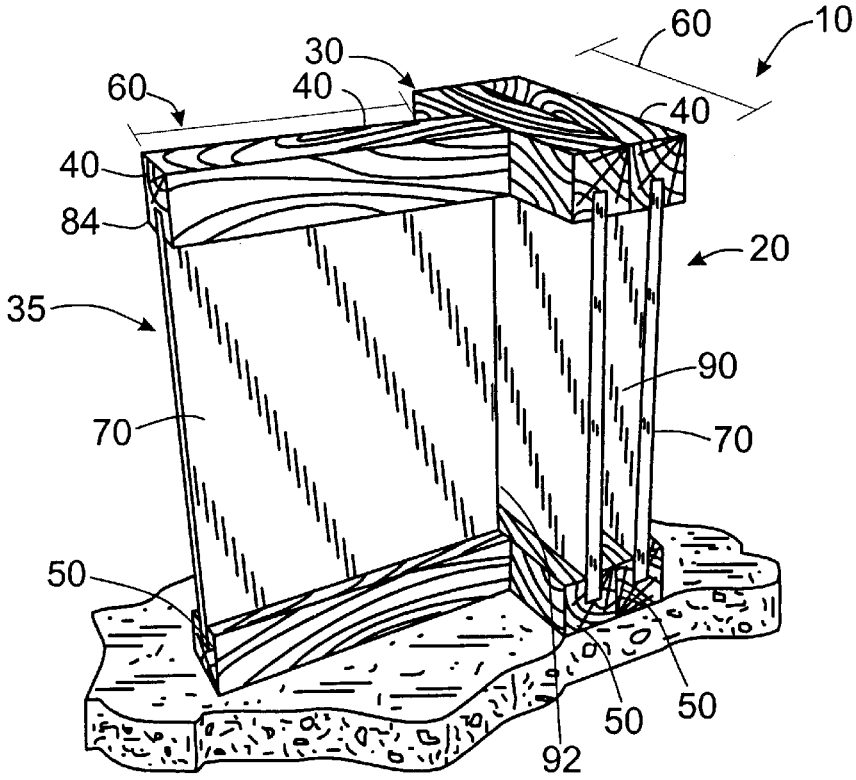
FIG. 1 is a perspective view of a draft block joist system comprising first and second elongated I-beams constructed in accordance with a preferred embodiment of the present invention, further illustrating a connection of a third elongated I-beam with respect to the second elongated I-beam.

Referring now to the drawings wherein the showings are for purposes of illustrating preferred embodiments of the present invention only, and not for purposes of limiting the same, FIG. 1 perspectively illustrates a draft block joist system ("system") 10 constructed in accordance with a preferred embodiment of the present invention. As indicated above, the system 10 is adapted to prevent an airflow circulation therethrough so as to significantly mitigate the deficiencies of the prior art joist systems.

Figure 2:
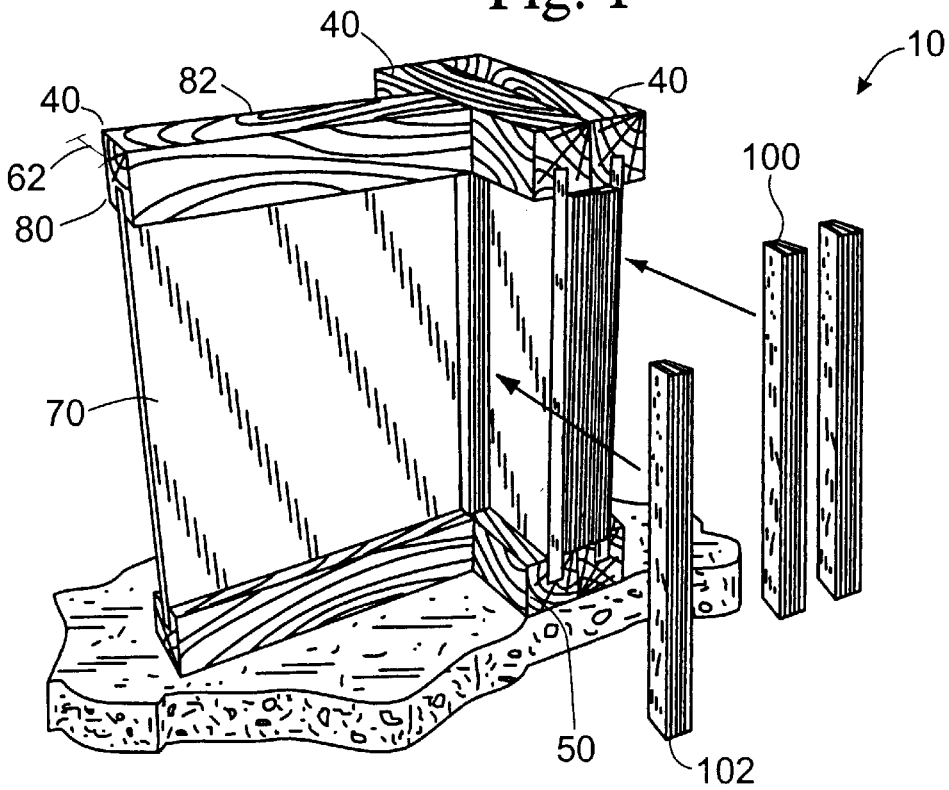
FIG. 2 is a perspective view of the draft block joist system shown in FIG. 1 illustrating air gaps formed thereby, further illustrating complimentary insulation members that are removably insertable into the air gaps.

Referring more particularly to FIGS. 1 and 2, the system 10 comprises a first elongated I-beam 20 and a second elongated I-beam 30 that are each preferably fabricated from a wooden material. The first and second elongated I-beams 20, 30 each has a continuous upper flange section 40 and a continuous lower flange section 50. Moreover, each of the upper and lower flange sections 40, 50 defines a flange length 60. For practicality reasons, it is preferred that the flange sections 40, 50 of the first elongated I-beam 20 have substantially identical flange lengths 60, whereas the flange sections 40, 50 of the second elongated I-beam are also the same.

Moreover, each of the upper and lower flange sections 40, 50 comprises a panel member 70 disposed therebetween. More specifically, the upper and lower flange sections 40, 50 each has an inner surface 80 and an outer surface 82. Each of the inner surfaces 80 defines a centrally extending contact surface 84 along the flange length 60 thereof for engaging the respective panel members 70 thereto. Each of the panel members 70 is preferably glued to the respective contact surfaces 84.

More particularly, the contact surfaces 84 are preferably elongated grooves that extend on the central areas of the inner surfaces 80 along the respective flange length 60. The elongated grooves should be sized and configured to correspond to respective edges of the panel members 70 so as to position the panel members 70 between the upper and lower flange sections 40, 50. In addition, the upper and lower flange sections 40, 50 of the first elongated I-beam 20 are respectively attached, preferably glued, to the upper and lower flange sections 40, 50 of the second elongated I-beam 30 along their respective flange lengths 60.

When the first and second elongated I-beams 20, 30 are preferably glued to each other, an air gap 90 is formed (as shown in FIG. 1). In particular, the air gap 90 is formed between the panel members 70 of the first and second elongated I-beams 20, 30. The air gap 90 is formed due to the nature of the shape and configuration of the respective upper and lower flange sections 40, 50. More particularly, each flange width 62 of the upper and lower flange sections 40, 50 of the respective I-beams 20, 30 are generally greater than the width of the respective panel members 70. Thus, when the first and second elongated I-beams 20, 30 are connected to each other along their respective flange lengths 60, the air gaps 90 are formed between the respective panel members 70 thereof.

As illustrated in FIGS. 1 and 2, the system 10 may further comprise a third elongated I-beam 35. The. third elongated I-beam 35 is substantially identical to the first and second elongated I-beams 20, 30 so there is no need to reiterate the features thereof. However, the third elongated I-beam 35 may define different flange length 60 and flange width 62 than the first and second elongated I-beams 20, 30 in order to increase or decrease surface area support. As such, structural descriptions of the first and second elongated I-beams 20, 30 are incorporated to describe the third elongated I-beam 35.

The third elongated I-beam 35 is connectable to the first or second elongated I-beam 20 or 30. As an exemplary illustration only, a connection between the second and third elongated I-beams 30, 35 will be described. However, such illustration should serve to depict the connection between the first and third elongated I-beams 20, 35 as well. The upper and lower flange sections 40, 50 of the third elongated I-beam 35 are connected, preferably glued, to the upper and lower flange sections 40, 50 of the second elongated I-beam 30 in a way that the respective flange lengths 60 thereof form a generally perpendicular relation with each other. Simultaneously, the flange width 62 of the third elongated I-beam 35 forms a generally parallel relation with the flange length 60 of the second elongated I-beam 30. The upper and lower flange sections 40, 50 are usually longer in lengthwise than that of the panel members 70 such that their respective end portions extend beyond the panel members 70. By such connection, another air gap 92 is formed between the panel members 70 of the second and third elongated I-beams 30, 35.

Moreover, the system 10 of the present invention further comprises an insulation member 100 (best shown in FIG. 2). Such insulation member 100 is preferably fabricated from a fiberglass material. More specifically, the insulation member 100 is formed from layers of fiberglass material. Because of the resilient characteristic of the fiberglass material, the insulation member 100 may be generally sized and configured to fit the air gap 90 so as to be complimentary thereto. Moreover, another insulation member 102, similar to the insulation member 100, is provided to be complimentary to the another air gap 92.

Figure 3:
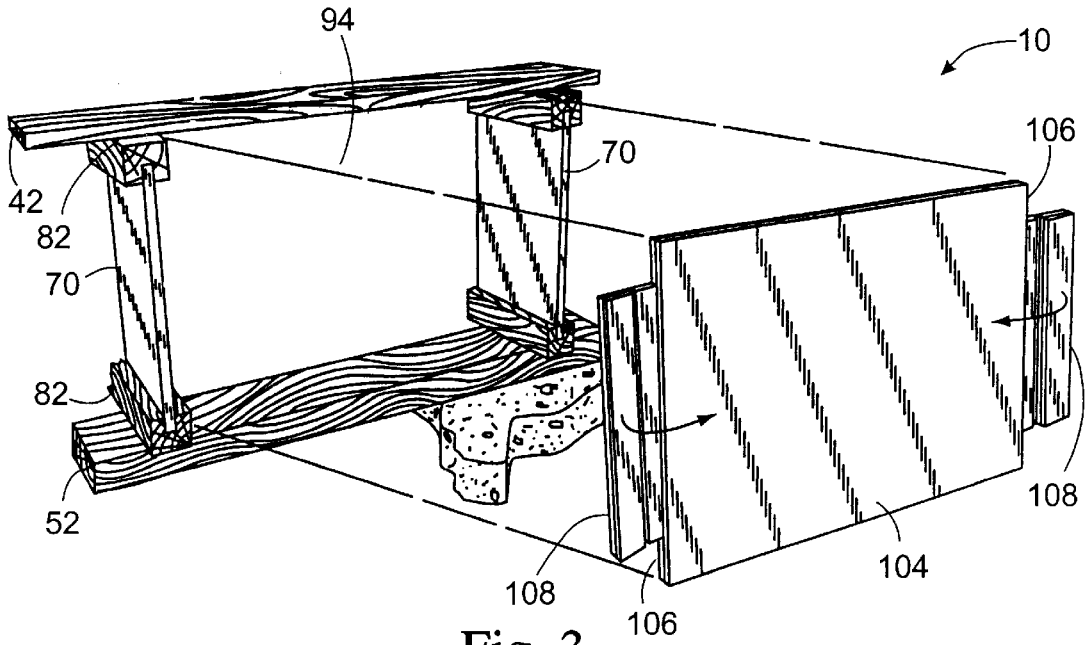
FIG. 3 is a perspective view of a draft block joist system when first and second elongated I-beams are positioned in generally parallel and spaced apart relation to form a dilated air gap via upper and lower elongated wooden pieces, further illustrating a complimentary dilated insulation member that is removably insertable into the dilated air gap.
Figure 4:
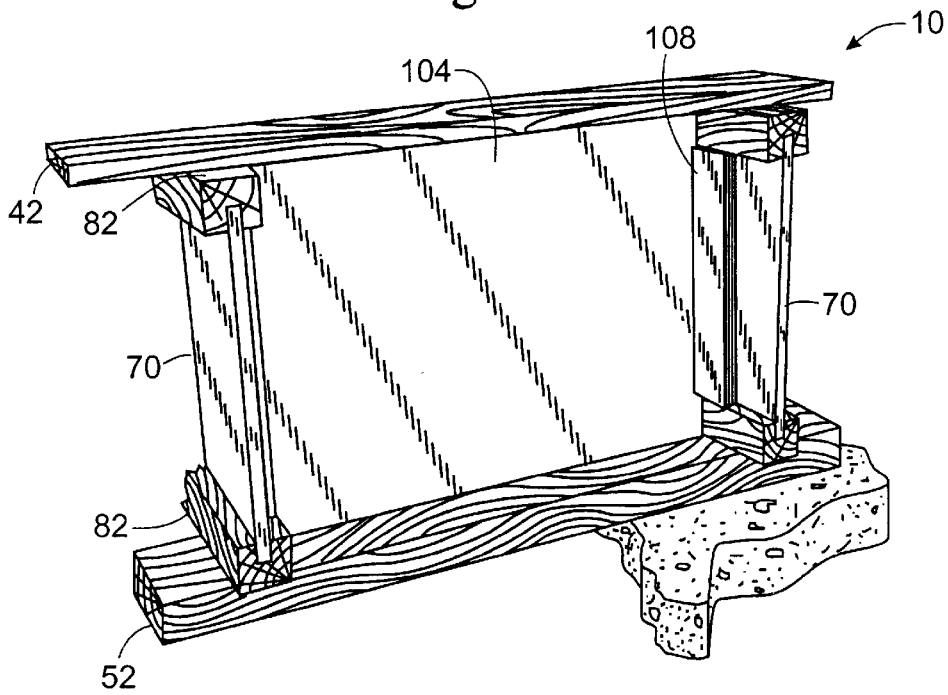
FIG. 4 is a perspective view of the draft block joist system shown in FIG. 3 when the dilated insulation member is engaged in the dilated air gap.

Referring now to FIGS. 3 and 4, the system 10 of the present invention may alternatively take a different configuration. Particularly, the first and second elongated I-beams 20, 30 are positioned in generally parallel and spaced apart relation in a manner shown in FIGS. 3 and 4. When such positioning occurs, upper and lower elongated wooden pieces 42, 52 are respectively placed and engaged on the outer surfaces 82 of the upper and lower flange sections 40, 50. By doing so, the first and second elongated I-beams 20, 30 are disposed between the respective inner end portions of the upper and lower elongated wooden pieces 42, 52 thereby forming a dilated air gap 94.

The dilated air gap 94 laterally extends between the first and second elongated I-beams 20, 30, namely, the respective panel members 70 thereof. Simultaneously, the dilated air gap 94 longitudinally extends between the upper and lower elongated wooden pieces 42, 52, namely, the inner surfaces thereof. Complimentary to the dilated air gap 94 is a dilated insulation member 104 having two opposing sides 106, and which is further preferably fabricated from a fiberglass material. Formed on the respective ones of the two opposing sides 106 are two radially extending appendages 108. The radially extending appendages 108 are also preferably fabricated from the fiberglass material, and are movable in relation to the opposing sides 106.

As will be recognized, the insulation member 100 and the another insulation member 102 are respectively configured for removable engagement to the air gap 90 and the another air gap 92 for preventing the airflow circulation therethrough. Because the insulation member 100 and the another insulation member 102 are preferably fabricated from the fiberglass material and thus resilient in nature, they may be generally sized to fit the respective air gaps 90, 92. As such, the insulation member 100 and the another insulation member 102 may contract so as to reflex back to their expanded shape when respectively inserted into the air gap 90 and the another air gap 92. By doing so, the insulation members 100, 102 immediately engage the respective air gaps 90, 92 via frictional force to block the air gaps 90, 92. Therefore, the airflow is prevented from circulating through the I-beam structure, namely, its air gaps 90, 92.

In the similar fashion, the dilated insulation member 104 is also complimentary to its corresponding air gap, namely, the dilated air gap 94 for removable engagement thereto. As the dilated insulation member 104 resiliently contracts for insertion into the dilated air gap 94 to thereby expand/reflex back to its original shape for frictional engagement thereto, the dilated air gap 94 is blocked. Moreover, the radially extending appendages 108 are movable against the panel members 70 to apply different degrees of frictional force when the dilated insulation member 104 is engaged to the dilated air gap 94.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A draft block joist system for preventing an airflow circulation therethrough, the system comprising:

first and second elongated I-beams each having continuous upper and lower flange sections with a panel member disposed therebetween, each of the upper and lower flange sections having a flange length and a centrally extending contact-surface for engaging the respective panel member thereto along the flange length, the upper and lower flange sections of the first elongated I-beam being respectively connectable with the upper and lower flange sections of the second elongated I-beam along their respective flange lengths;

an air gap formed between the panel members of the first and second elongated I-beams when the respective upper and lower flange sections are connected with each other along their respective flange lengths; and an insulation member removably insertable into the air gap and being retainable therein via frictional engagement for preventing the airflow circulation therethrough.

2. The system of claim 1 wherein the first and second elongated I-beams are each fabricated from a wooden material.

3. The system of claim 1 wherein each of the upper and lower flange sections has an inner surface, each of the inner surfaces defining the centrally extending contact surface along the flange length thereof for engaging the respective panel members thereto.

4. The system of claim 3 wherein each of the contact surfaces is an elongated groove.

5. The system of claim 3 wherein each of the panel members is glued to the respective contact surfaces.

6. The system of claim 1 wherein the upper and lower flange sections of the first elongated I-beam are respectively glued to the upper and lower flange sections of the second elongated I-beam along their respective flange lengths.

7. The system of claim 1 wherein the insulation member is fabricated from a fiberglass material.

8. The system of claim 1 further comprising upper and lower elongated wooden pieces, and wherein the first and second elongated I-beams are positioned in generally parallel and spaced apart relation, each of the upper and lower flange sections having an outer surface, the upper and lower elongated wooden pieces being respectively engaged on the outer surfaces of the upper and lower flange sections so as to position the first and second elongated I-beams therebetween.

9. The system of claim 8 wherein a dilated air gap is formed when the upper and lower elongated wooden pieces position the first and second elongated I-beams therebetween, the dilated air gap laterally extending between the first and second elongated I-beams, the dilated air gap longitudinally extending between the upper and lower elongated wooden pieces.

10. The system of claim 9 wherein a dilated insulation member having two opposing sides is sized and configured to correspond to the dilated air gap, the dilated insulation member further having two radially extending appendages formed on respective ones of the opposing sides thereof to enhance frictional engagement to the dilated air gap when inserted therein.

11. The system of claim 1 further comprising a third elongated I-beam having continuous upper and lower flange sections with a panel member disposed therebetween, each of the upper and lower flange sections of the third elongated I-beam having a flange length, a flange width and a centrally extending hollow groove for engaging the panel member thereto along the flange length, the third elongated I-beam being connectable with the second elongated I-beam in a way that the respective flange lengths thereof form a generally perpendicular relation with each other, whereas the flange width of the third elongated I-beam forms a generally parallel relation with the flange length of the second elongated I-beam.

12. The system of claim 11 wherein another air gap is formed between the panel members of the second and third elongated I-beams when the upper and lower flange sections of the second elongated I-beam respectively connect with the upper and lower flange sections of the third elongated I-beam.

13. The system of claim 12 wherein another insulation member is removably insertable into the another air gap for preventing the airflow circulation therethrough.

14. A method of utilizing an insulation member for preventing an airflow circulation through a draft block joist system, the joist system comprising first and second elongated I-beams each having continuous upper and lower flange sections with a panel member disposed therebetween, each of the upper and lower flange sections having a flange length and a centrally extending hollow groove for engaging the respective panel member thereto along the flange length, the method comprising the steps of:

a) respectively connecting the upper and lower flange sections of the first elongated I-beam with the upper and lower flange sections of the second elongated I-beam along their respective flange lengths;

b) forming an air gap between the panel members of the first and second elongated I-beams when the respective upper and lower flange sections are connected with each other along their respective flange lengths; and c) removably inserting an insulation member into the air gap to be retained therein via frictional engagement for preventing the airflow circulation therethrough.

15. The method of claim 14 wherein the insulation member is fabricated from a fiberglass material.

16. The method of claim 14 further comprising a third elongated I-beam having continuous upper and lower flange sections with a panel disposed therebetween, each of the upper and lower flange sections of the third elongated I-beam having a flange length, a flange width and a centrally extending hollow groove for engaging the panel member thereto along the flange length, and wherein the method further comprising the steps of:

d) connecting the third elongated I-beam with the second elongated I-beam in a way that the respective flange lengths thereof form a generally perpendicular relation with each other, whereas the flange width of the third elongated I-beam forms a generally parallel relation with the flange length of the second elongated I-beam;

e) forming another air gap between the panel members of the second and third elongated I-beams when the upper and lower flange sections of the second elongated I-beam respectively connect with the upper and lower flange sections of the third elongated I-beam; and f) removably inserting another insulation member into the another air gap for preventing the airflow circulation therethrough.

17. A method of utilizing an insulation member for preventing an airflow circulation through a draft block joist system, the joist system comprising first and second elongated I-beams each having continuous upper and lower flange sections with a panel member disposed therebetween, each of the upper and lower flange sections having a flange length, an outer surface and a centrally extending hollow groove for engaging the respective panel member thereto along the flange length, the method comprising the steps of:

a) positioning the first and second elongated I-beams in generally parallel and spaced apart relation;

b) respectively engaging upper and lower elongated wooden pieces on the outer surfaces of the upper and lower flange sections so as to position the first and second elongated I-beams therebetween;

c) forming a dilated air gap when the upper and lower elongated wooden pieces position the first and second elongated I-beams therebetween, the dilated air gap laterally extending between the first and second elongated I-beams, the dilated air gap longitudinally extending between the upper and lower elongated wooden pieces; and d) inserting a dilated insulation member having two opposing sides into the dilated air gap to be retained therein via frictional engagement, the dilated insulation member being sized and configured to correspond to the dilated air gap, the dilated insulation member further having two radially extending appendages formed on respective ones of the opposing sides thereof to enhance the frictional engagement to the dilated air gap when inserted therein.

18. The method of claim 17 wherein the dilated insulation member is fabricated from a fiberglass material.

19. A draft block joist system for preventing an airflow circulation therethrough, the system comprising:

first and second elongated I-beams each having continuous upper and lower flange sections with a panel member disposed therebetween, each of the upper and lower flange sections having a flange length and a centrally extending contact surface for engaging the respective panel member thereto along the flange length, the upper and lower flange sections of the first elongated I-beam being respectively connectable with the upper and lower flange sections of the second elongated I-beam along their respective flange lengths;

a third elongated I-beam having continuous upper and lower flange sections with a panel member disposed therebetween, each of the upper and lower flange sections of the third elongated I-beam having a flange length, a flange width and a centrally extending hollow groove for engaging the panel member thereto along the flange length, the third elongated I-beam being connectable with the second elongated I-beam in a way that the respective flange lengths thereof form a generally perpendicular relation with each other, whereas the flange width of the third elongated I-beam forms a generally parallel relation with the flange length of the second elongated I-beam;

an air gap formed between the panel members of the first and second elongated I-beams when the respective upper and lower flange sections are connected with each other; and an insulation member removably insertable into the air gap for preventing the airflow circulation therethrough.

20. The system of claim 19 wherein the insulation member is fabricated from a fiberglass material.

21. The system of claim 19 wherein another air gap is formed between the panel members of the second and third elongated I-beams when the upper and lower flange sections of the second elongated I-beam respectively-connect with the upper and lower flange sections of the third elongated I-beam.

22. The system of claim 21 wherein another insulation member is removably insertable into the another air gap for preventing the airflow circulation therethrough.

23. A method of utilizing an insulation member for preventing an airflow circulation through a draft block joist system, the joist system comprising first and second elongated I-beams each having continuous upper and lower flange sections with a panel member disposed therebetween, each of the upper and lower flange sections having a flange length and a centrally extending hollow groove for engaging the respective panel member thereto along the flange length, the joint system further comprising a third elongated I-beam having continuous upper and lower flange sections with a panel disposed therebetween, each of the upper and lower flange sections of the third elongated I-beam having a flange length, a flange width and a centrally extending hollow groove for engaging the panel member thereto along the flange length, the method comprising the steps of:

a) respectively connecting the upper and lower flange sections of the first elongated I-beam with the upper and lower flange sections of the second elongated I-beam along their respective flange lengths;

b) forming an air gap between the panel members of the first and second elongated I-beams when the respective upper and lower flange sections are connected with each other;

c) connecting the third elongated I-beam with the second elongated I-beam in a way that the respective flange lengths thereof form a generally perpendicular relation with each other, whereas the flange width of the third elongated I-beam forms a generally parallel relation with the flange length of the second elongated I-beam;

d) forming another air gap between the panel members of the second and third elongated I-beams when the upper and lower flange sections of the second elongated I-beam respectively connect with the upper and lower flange sections of the third elongated I-beam;

e) removably inserting an insulation member into the air gap for preventing the airflow circulation therethrough; and f) removably inserting another insulation member into the another air gap for preventing the airflow circulation therethrough.

24. The method of claim 23 wherein the insulation member is fabricated from a fiberglass material.

* * * * *